US006636151B2

(12) United States Patent
Busick

(10) Patent No.: US 6,636,151 B2
(45) Date of Patent: Oct. 21, 2003

(54) WATER DISPENSING STATION WITH COMMUNICATION SYSTEM

(75) Inventor: Louis M. Busick, Columbus, OH (US)

(73) Assignee: Oasis Corporation, Columbus, OH (US)

( * ) Notice: Subject to any disclaimer, the term of this patent is extended or adjusted under 35 U.S.C. 154(b) by 0 days.

(21) Appl. No.: 09/895,013

(22) Filed: Jun. 27, 2001

(65) Prior Publication Data

US 2002/0101346 A1 Aug. 1, 2002

Related U.S. Application Data

(60) Provisional application No. 60/214,671, filed on Jun. 27, 2000.

(51) Int. Cl.[7] ..... G08B 19/00

(52) U.S. Cl. ..... 340/521; 340/539.1; 340/539.11; 340/585; 700/282; 700/283; 222/146.1

(58) Field of Search ..... 340/521, 539.1, 340/585, 584, 539.11; 700/282, 283; 222/146.1

(56) References Cited

U.S. PATENT DOCUMENTS

| | | | | |
|---|---|---|---|---|
| 5,608,643 | A | 3/1997 | Wichter et al. | |
| 5,677,677 | A | * 10/1997 | Duff et al. | 340/585 |
| 5,784,441 | A | 7/1998 | Davis et al. | |
| 5,889,684 | A | * 3/1999 | Ben-David et al. | 222/146.1 |
| 6,061,430 | A | 5/2000 | Miller et al. | |
| 6,377,589 | B1 | 4/2002 | Knight et al. | |

FOREIGN PATENT DOCUMENTS

| | | |
|---|---|---|
| WO | WO 02/473369 | 6/2002 |

* cited by examiner

*Primary Examiner*—Daryl Pope

(74) *Attorney, Agent, or Firm*—Kelly Bauersfeld Lowry & Kelley, LLP

(57) ABSTRACT

A water dispensing station includes a source of water a water temperature adjustment system connected to the source of water and adapted to adjust water obtained from the source of water, a temperature sensor positioned to sense water temperature of water in the temperature adjusting system, and a dispensing system connected to the water temperature adjusting system and adapted to selectively dispense water. A controller has processing and memory means and is connected to the water temperature adjusting system and the temperature sensor. The controller is adapted to receive and store water temperature information from the temperature sensor. The station preferably includes a display screen to display information from the controller and input means for the user to input information to the controller. The station can further include a modem so that the controller can communicate with a remote service center. Preferably, the modem is in communication with the controller via transceivers and the modem automatically receives calls from the remote service center. The controller can automatically alert the remote service center when there is a need for service such as filter replacement, component replacement, or bottled water delivery or can alert the remote service center that the user desires to be contacted by the remote service center. The remote service center can check status of the station and send message to the user such as replacement filters are on the way or bottled water will be delivered on a certain date.

34 Claims, 8 Drawing Sheets

WATER DISPENSING STATION WITH COMMUNICATION SYSTEM

CROSS-REFERENCE TO RELATED APPLICATIONS

This application claims priority of U.S. Provisional Patent Application No. 60/214,671 filed on Jun. 27, 2000.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to an improved water dispensing station such as, for example, a bottled water cooler and, more particularly, to a water dispensing station having a communication system for transmitting information to auxiliary devices such as, for example, a computer at a remote service center or a PDA of a service technician.

BACKGROUND OF THE INVENTION

Bottled water coolers are typically purchased by a water provider such as a bottled water company and rented or leased to customers for use in an office or home along with providing bottled water to the customers for dispensing from the cooler. Because the water provider owns the coolers, it must repair and maintain the coolers. When a customer calls the water provider about a failure or other problem, the water provider must make a service call by sending a service technician to the site of the cooler. Often the problem is nothing more than a hot or cold thermostat which is not set at a temperature which suits the customer. This is easily corrected but costs the water provider a substantial amount of money for the unplanned service call. Each unplanned service call results in less time for scheduled deliveries and sales calls. Filtered and reverse osmosis water coolers have the additional requirement that filters must be replaced during regular service calls.

The service calls are not only costly to the water provider. They can also be inconvenient for the customer which typically must be available during the service call. In fact, it is believed that many potential customers choose not to obtain water services because of the inconvenience of regular service calls.

Accordingly, there is a need in the art for improved water dispensing stations and methods of operating and servicing water dispensing stations which reduce the number of service calls, reduce the number of deliveries, have invisible or nearly invisible service as perceived by the customer, have increased energy efficiency, and are highly reliable to operate.

SUMMARY OF THE INVENTION

The present invention provides a water dispensing station which overcomes at least some of the above-noted problems of the related art. According to the present invention, a water dispensing station includes, in combination a source of water, a water temperature adjustment system connected to the source of water and adapted to adjust water obtained from the source of water, a temperature sensor positioned to sense water temperature of water in the temperature adjusting system, and a dispensing system connected to the water temperature adjusting system and adapted to selectively dispense water. A controller has processing means and memory means and is in communication with the water temperature adjusting system and the temperature sensor. The controller is adapted to receive and store water temperature information from the temperature sensor.

According to another aspect of the present invention, a water dispensing station includes a source of water, a water treatment system connected to the source of water and adapted to treat water obtained from the source of water, and a dispensing system connected to the water treatment system and adapted to selectively dispense water. A controller has processing means and memory means and is in communication with the water treatment system. A modem in communication with the controller and the controller is adapted to communicate information via the modem to a remote service center.

According to yet another aspect of the present invention, a water dispensing station includes a source of water, a water treatment system connected to the source of water and adapted to treat water obtained from the source of water, and a dispensing system connected to the water treatment system and adapted to selectively dispense water. A controller has processing means and memory means and is in communication with the water treatment system. A transceiver is in communication with the controller and the controller is adapted to communicate with at least one of a personal digital assistant, a personal computer, and a modem via the transceiver.

From the foregoing disclosure and the following more detailed description of various preferred embodiments it will be apparent to those skilled in the art that the present invention provides a significant advance in the technology and art of water dispensing systems. Particularly significant in this regard is the potential the invention affords for providing a high quality, customer friendly, energy efficient, reliable, low cost system. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1A:
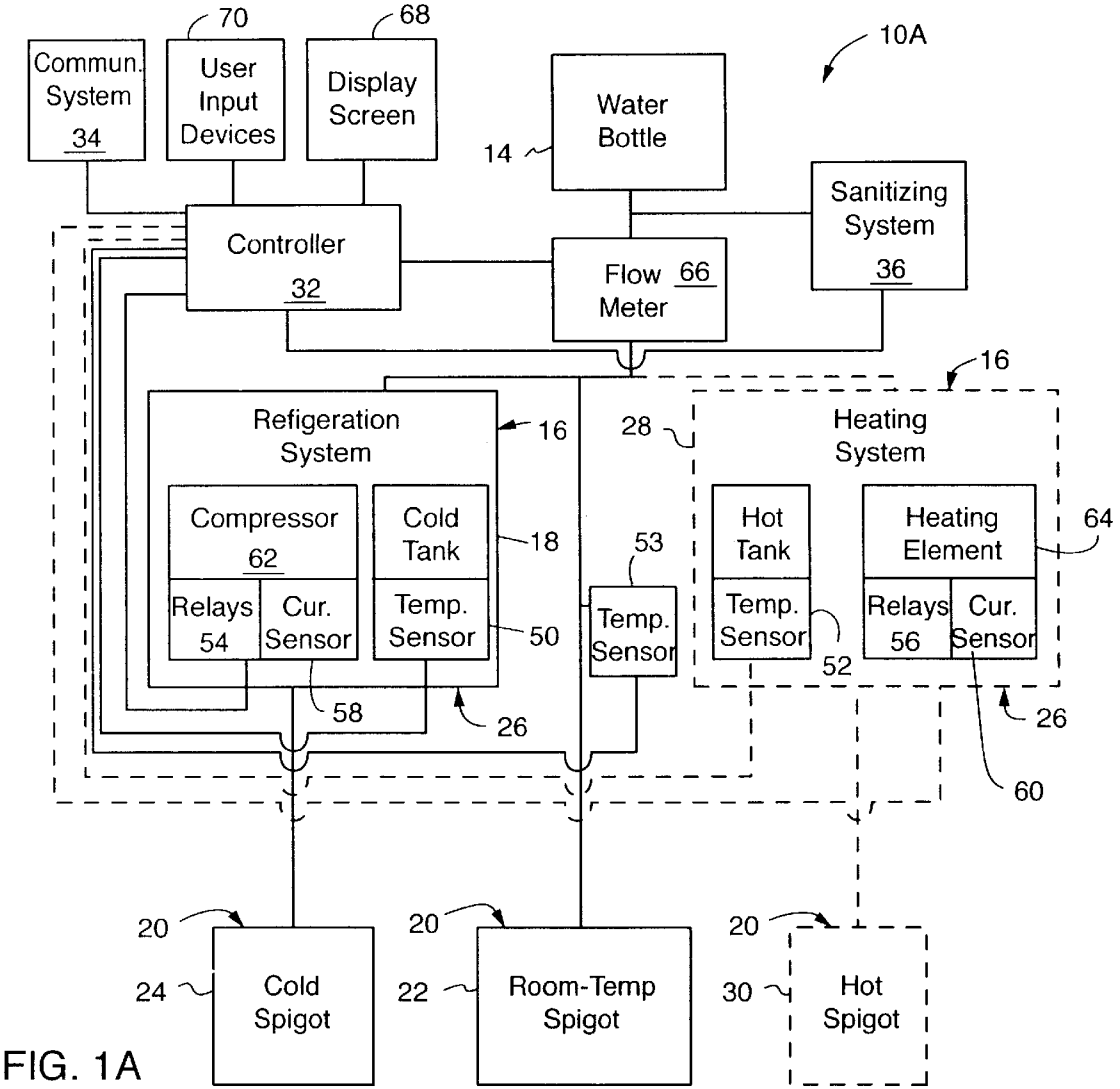
FIG. 1A is a schematic diagram of the water dispensing station of FIG. 1.
Figure 1:
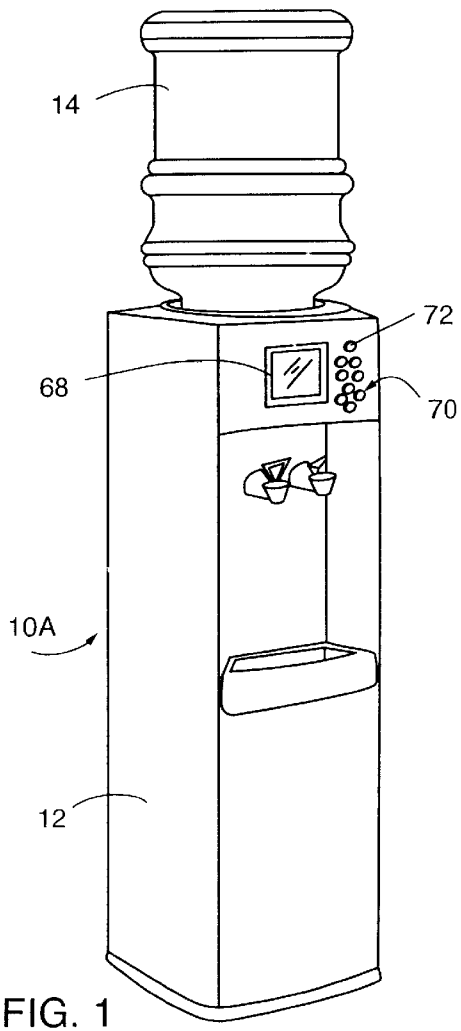
FIG. 1 is a perspective view of a free-standing bottled water dispensing station according to a preferred embodiment of the present invention.

It should be understood that the appended drawings are not necessarily to scale, presenting a somewhat simplified representation of various preferred features illustrative of the basic principles of the invention. The specific design features of the water dispensing stations as disclosed herein, including, for example, specific dimensions, orientations, and shapes of various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the water dispensing stations illustrated in the drawings. In general, up or upward refers to an upward direction in the plane of the paper in FIGS. 1 to 4 and down or downward refers to a downward direction in the plane of the paper in FIGS. 1 to 4.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved water dispensing stations disclosed herein. The following detailed discussion of various alternative and preferred embodiments will illustrate the general principles of the invention with reference to water coolers for commercial or residential use. Other embodiments suitable for other applications will be apparent to those skilled in the art given the benefit of this disclosure.

Figure 2A:
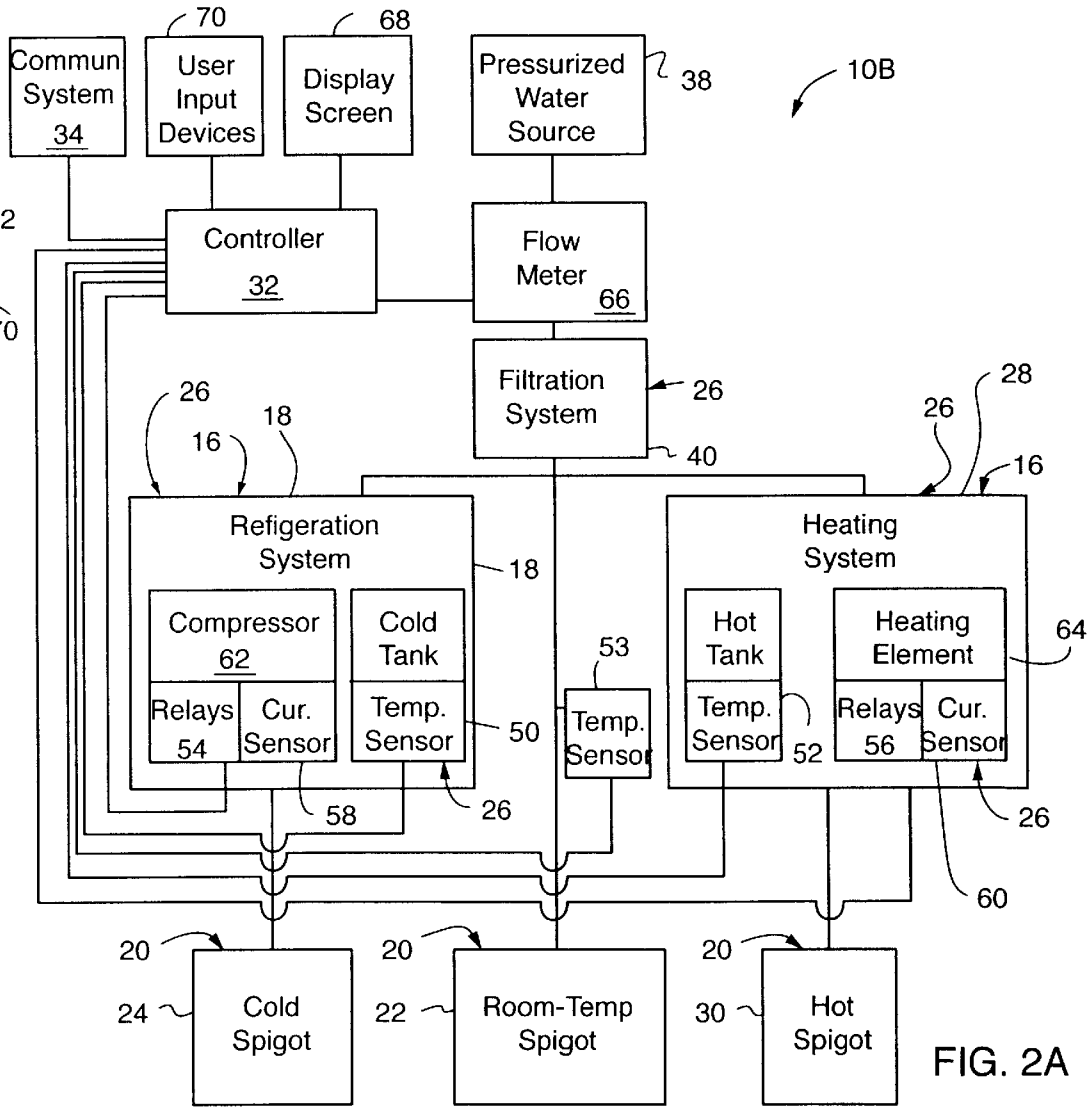
FIG. 2A is a schematic diagram of the water dispensing station of FIG. 2.
Figure 2:
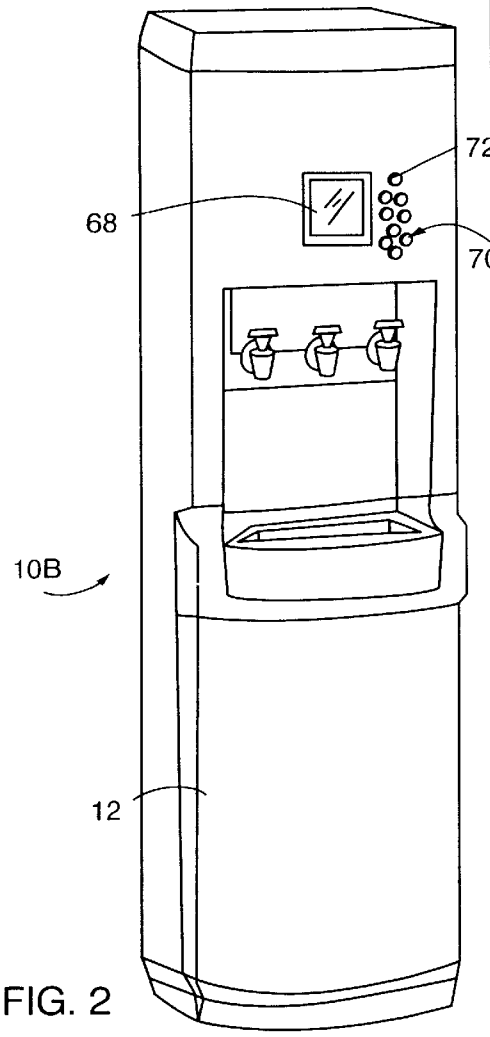
FIG. 2 is a perspective view of a free-standing filtration water dispensing station according to a preferred embodiment of the present invention.
Figure 3A:
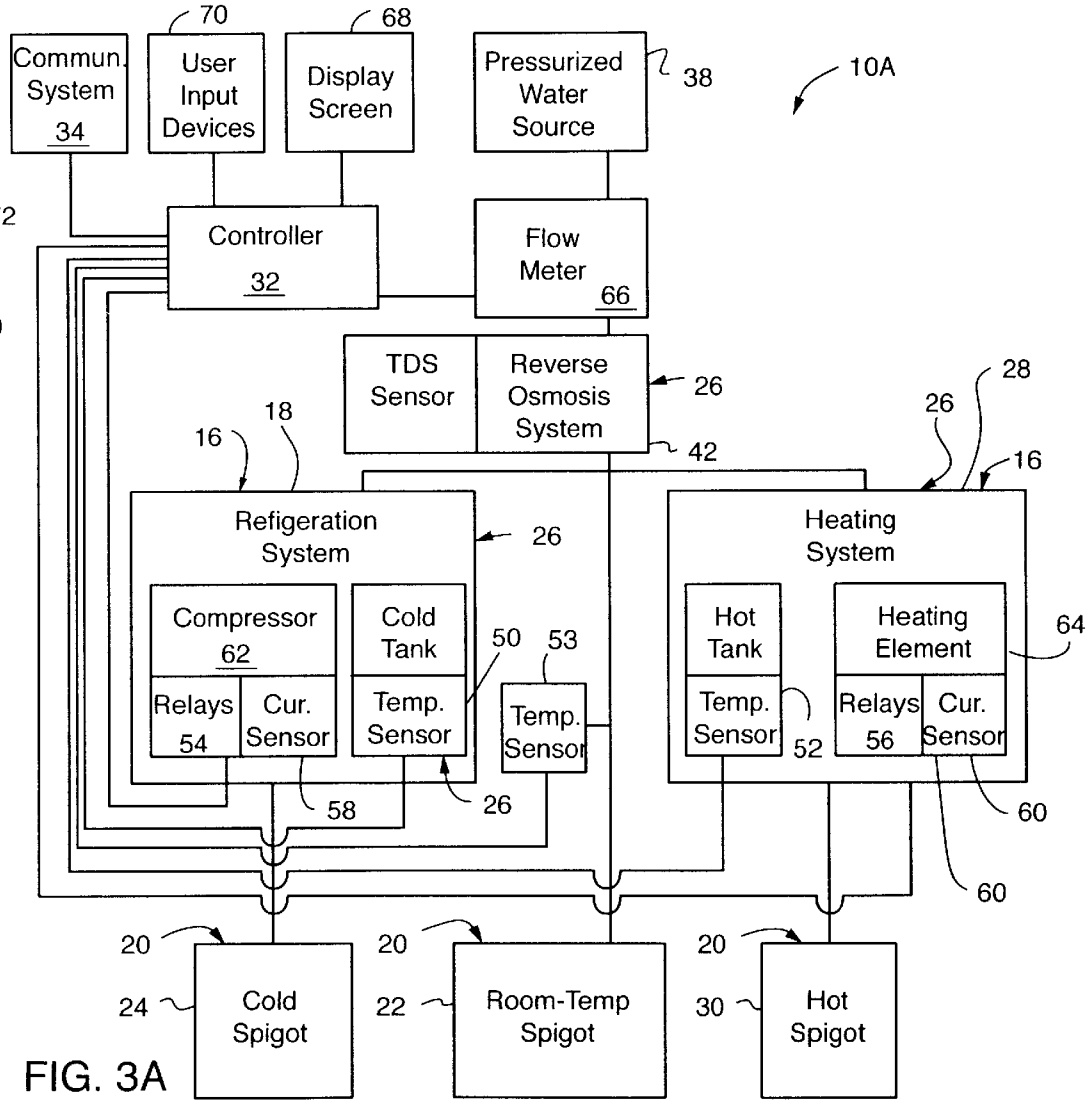
FIG. 3A is a schematic diagram of the water dispensing station of FIG. 3.
Figure 3:
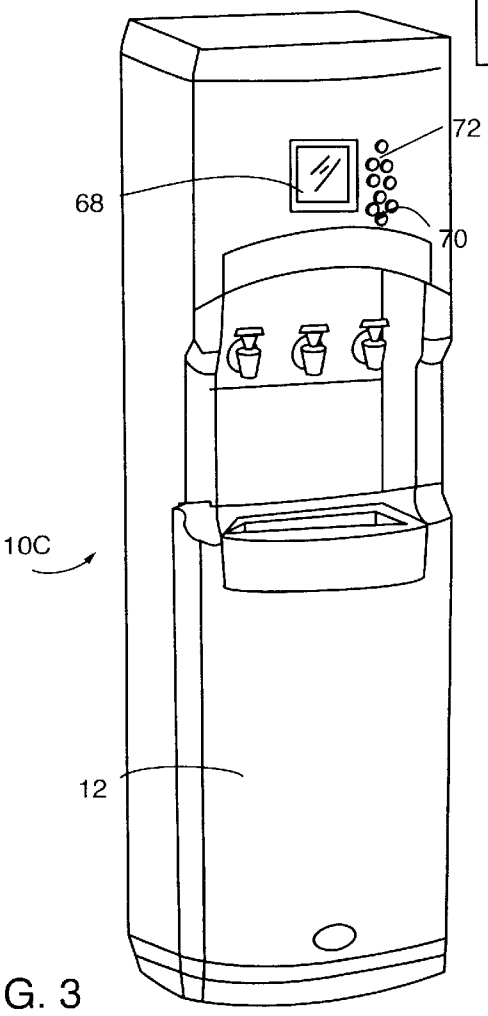
FIG. 3 is a perspective view of a free-standing reverse osmosis water dispensing station according to a preferred embodiment of the present invention.
Figure 4A:
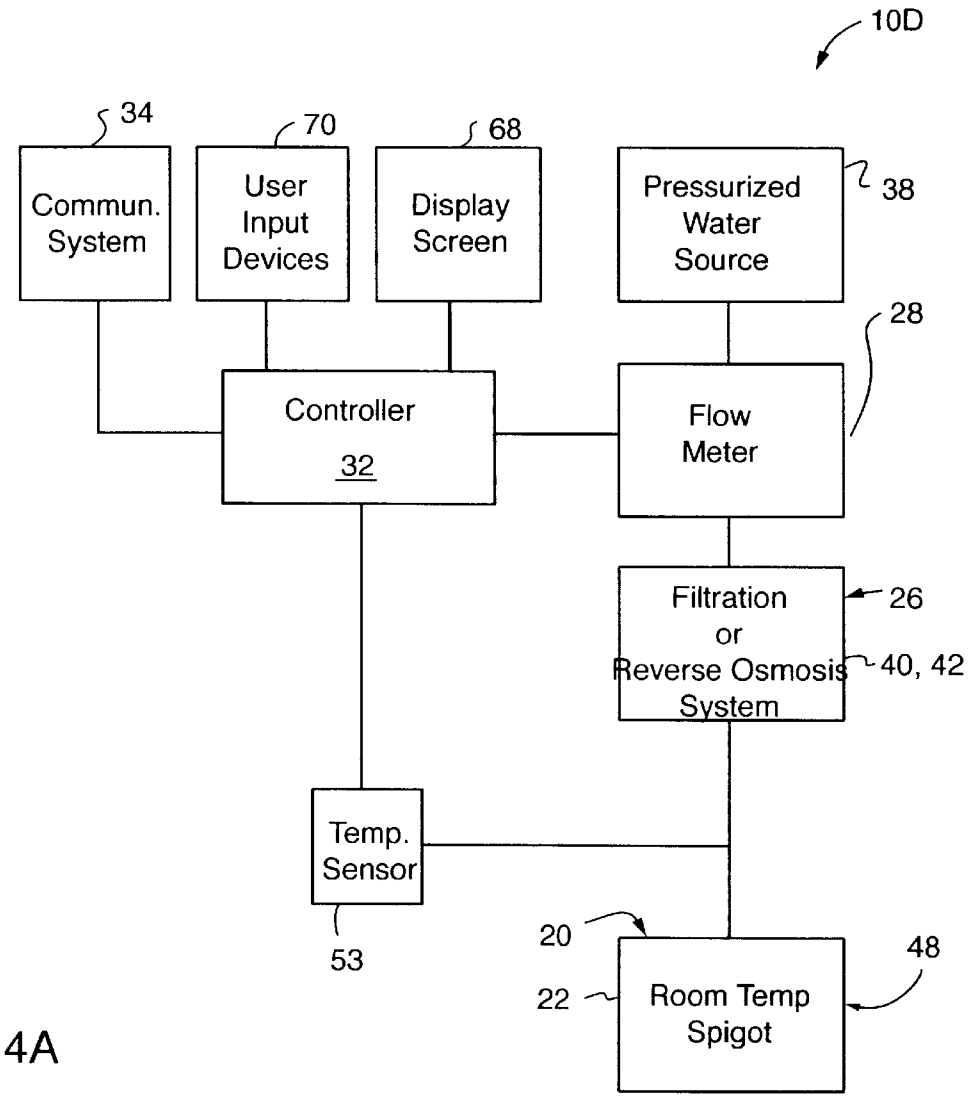
FIG. 4A is a schematic diagram of the water dispensing station of FIG. 4.
Figure 4:
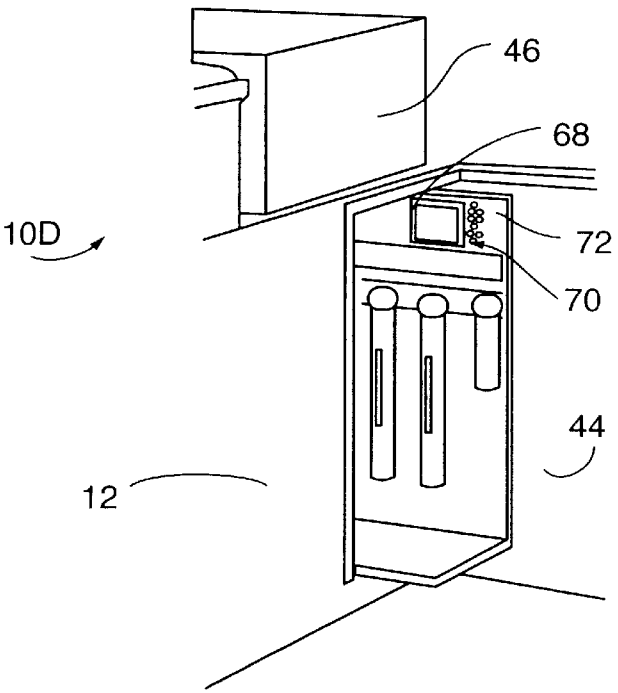
FIG. 4 is a perspective view of a kitchen sink with an under-sink water system according to a preferred embodiment of the present invention.

Referring now to the drawings, FIGS. 1 to 4A show various types of water dispensing stations according to preferred embodiments of the present invention: a free-standing bottled water dispensing station 10A (FIGS. 1 and 1A); a free-standing filtration water dispensing station 10B (FIGS. 2 and 2A); a free-standing reverse-osmosis water dispensing station 10C (FIGS. 3 and 3A); and a kitchen sink with an under-sink water treatment system 10D (FIGS. 4 and 4A). While several types of water dispensing stations 10A–10D have been illustrated, other types of water dispensing stations are within the scope of the present invention such as, for example, counter top stations or stations with remotely located refrigeration or heating systems.

The illustrated bottled water dispensing station 10A has a cabinet 12 adapted for receiving a source of water such as a bottle of water 14, a water temperature adjustment system 16 such as an internal refrigeration or cooling system 18 within the cabinet 12 for cooling water, and a water dispensing system 20 such as a pair of spigots 22, 24 for dispensing room-temperature or non-refrigerated water and cold or refrigerated water respectively. It is noted that the bottled water dispensing station 10A can alternatively have additional water treating systems 26 such as a heating system 28 and a third spigot 30 for dispensing hot or heated water (as seen in FIGS. 2 and 3) or can alternatively have any one or two of the room temperature, cold, and hot water spigots 22, 24, 30. The refrigeration and dispensing systems 18, 20 (and heating system 28 if present) can be of any suitable type such as, for example, those provided in Model Nos. B1RRK, B1RRHS, B1SRK, and B1SRHS manufactured by the Oasis Corporation, Columbus, Ohio. The bottled water dispensing station 10A also includes an electronic control system having a controller 32 for controlling the refrigeration system 18 (and heating system 28 if present) and a communication system 34 for exchanging information with other devices either locally or at remote locations. The bottled water dispensing station 10A can also have a sanitizing system 36 incorporating ultraviolet, ozone, or the like treatments to sanitize components such as a water reservoir fed by the water bottle 14.

The illustrated filtration water dispensing station 10B generally includes each of the components of the bottled water dispensing station 10A except that it is adapted to be connected to a pressurized source of water 38 rather than receiving the bottle of water 14 and includes a filtration system 40 for treating water before it is dispensed. The filtration system 40 can be of any suitable type such as, for example, those provided in Model Nos. PF1AQK, PF1AQKY, PQF1AQK, PQF1AQKY, PHF1AQHK, PHF1AQHKY, PQF1AQHK, and PQF1AQHKY manufactured by the Oasis Corporation, Columbus, Ohio.

The illustrated reverse osmosis water dispensing station 10C generally includes each of the components of the filtration dispensing station 10B except that it includes a reverse osmosis system 42 for treating water before it is dispensed rather than the filtration system 40. The reverse osmosis system 42 can be of any suitable type such as, for example, those provided in Model Nos. PST1AQHK, PST1AQK, PHT1AQHK, and PHT1AQK manufactured by the Oasis Corporation, Columbus, Ohio.

The illustrated kitchen sink with under-sink water treatment system 10D generally includes the same components as either the free-standing filtration water dispensing station 10B or the free-standing reverse-osmosis water dispensing station 10C except that it is located in a built-in kitchen cabinet 44 beneath the sink 46 rather than in the free-standing cabinet 12 and has a built-in spigot or faucet 48 located at the sink 46. It is noted that alternatively, the components can be located at other locations remote from the built-in spigot 48 from which the water is dispensed, such as, for example, another cabinet, a closet, the basement, or other suitable remote location.

The electronic control system includes the microprocessor based controller 32, temperature sensors 50, 52, 53 for measuring cold, hot and/or room temperatures, relays 54, 56 for activating and deactivating the refrigeration and/or heating systems 18, 28, and current sensors 58, 60 for measuring current. The controller 32 preferably has memory means and processing means and is suitably programmed to perform desired functions as described in more detail hereinafter. The controller 32 preferably also has timer or clock means in order to determine the amount of time since a stored event. The temperature sensors 50, 52 are located in positions to sense temperatures indicative of cold and/or hot water temperatures and are in communication with the controller 32. The temperature sensors 50, 52 are preferably thermisters, thermocouples, or the like. The relays 54, 56 are preferably located in positions to activate and deactivate a compressor 62 of the refrigeration system 18 and/or a heating element 64 of the heating system 28 and are in communication with the controller 32. The relays 54, 56 can be either solid state or mechanical. The current sensors 58, 60 are in communication with the controller 32 and are preferably adapted to give an indication of the operation of the compressor 62 and the heating element 64. The current sensors 58, 60 can be of any suitable type. The illustrated control system includes a flow meter 66 in communication with the controller 32 and positioned to indicate the amount of water that is dispensed. The illustrated control system also includes a display screen 68 such as, for example, an LCD or other suitable screen to display information to the user from the controller 32 and suitable input devices 70 such as the illustrated push buttons or touch screen buttons for the user to interact with the dispensing station 10A–10D and provide information to the controller 32. Preferably, one of the user input devices 70 is a call button 72 which can be utilized by the user as described in more detail hereinafter.

The controller 32 preferably monitors and stores information including: the cold water temperature; the hot water temperature; the "room-temperature" water temperature; the amperage of the refrigeration system compressor 62; the amperage of the heating system heating element 64; the amount of time the refrigeration system compressor 62 is operating (can be a percent of total run); the amount of time the heating system heating element 64 (hot tank) is operating; the number of gallons of water dispensed over a predetermined period of time such as a month, since bottles were delivered, since the filters of the filtration system 40 were installed (to determine filter life), or since the reverse osmosis system 42 has been serviced; for the bottled water distribution station 10A, the number of bottles of water 14 used over a predetermined period of time such as a month or since bottles 14 were last delivered; the number of bottles 14 delivered and the date delivered the amount of time since the filters of the filtration system 40 were replaced; and for the reverse-osmosis water dispensing station 10C, the Total Dissolved Solids (TDS) of water exiting the reverse osmosis system 42.

The controller 32 is preferably adapted to control various functions of the station 10A–10D such as: automatically controlling the cold water temperature to a desired temperature by turning the refrigeration system compressor 62 on and off via the relays 54 at suitable times; automatically controlling the hot water temperature to a desired temperature by turning the heating system heating element 64 on and off via the relays 56 at the suitable times; automatically turning off the cooling and/or heating systems 18, 28 via the relays 54, 56 during non-use periods, such as during evenings or weekends in an office or daytime and night in a home, to conserve energy; determining non-use and/or off-peak periods via fuzzy logic or the like; automatically operating the system in an energy saver mode in periods of low usage (off-peak periods); operating an internal clock/calendar; automatically activating a visible and/or audible alarm when the compressor 62, heating element 64, or other component has failed; automatically activating a visible or audible alarm when a water leak is detected; monitoring filter life and automatically alerting the user or a remote service center 74 that filters need to be replaced; monitoring TDS and automatically alerting the user or the service center 74 that filters need to be replaced; operating the display screen 68 to display information to the user, and receiving inputs from the user input devices 70 to receive information from the user; automatically initiating calls to the service center 74 as needed in response to input from system components or the user; automatically receiving calls from the service center 74; running diagnostics based on symptoms or failures and recommend a corrective course of action either locally or remotely from the service center 74; automatically communicating with auxiliary devices; identifying the dispensing station 10A–10D by a unique serial number; identifying the dispensing station 10A–10D as being owned by a specific company such as company XYZ (to be utilized if the dispensing station 10A–10D is stolen); requiring and receiving authorization from an auxiliary device, such as a computer at the remote service center 74, before permitting operation of the water dispensing station 10A–10D; receiving instructions from an auxiliary device, such as a computer at the remote service center 74, and shutting down the water dispensing station 10A–10D (to be used, for example, when the user has not paid bills); automatically initiating a sanitizing cycle of the sanitizing system 36 with UV, ozone, or other suitable methods on a predetermined schedule and/or at off-peak periods; and automatically maintaining service records for the water dispensing station 10A–10D.

The communication system 34 includes a transceiver 76 which is in communication with the controller 32 and is preferably adapted to provide a wireless connection between the controller 32 and auxiliary devices. The wireless connection can be formed by any suitable wireless technology such as, for example, radio, infrared, and/or home electrical-wiring technology. Radio technology provides transmitters which send low power signals at radio frequencies such as, for example, 2.4 GHz through air ways between devices which are located within range of the signals. Home electrical wiring technology provides transmitters which send signals, at frequencies such as 900 MHz, over a buildings electrical wiring system between devices which are "plugged into" outlets of the electrical wiring system. The wireless communication can utilize any suitable protocol such as, for example, BLUETOOTH, HLT, e-SMART, X.10, JINI, and UNIVERSAL PLUG AND PLAY.

Figure 5:
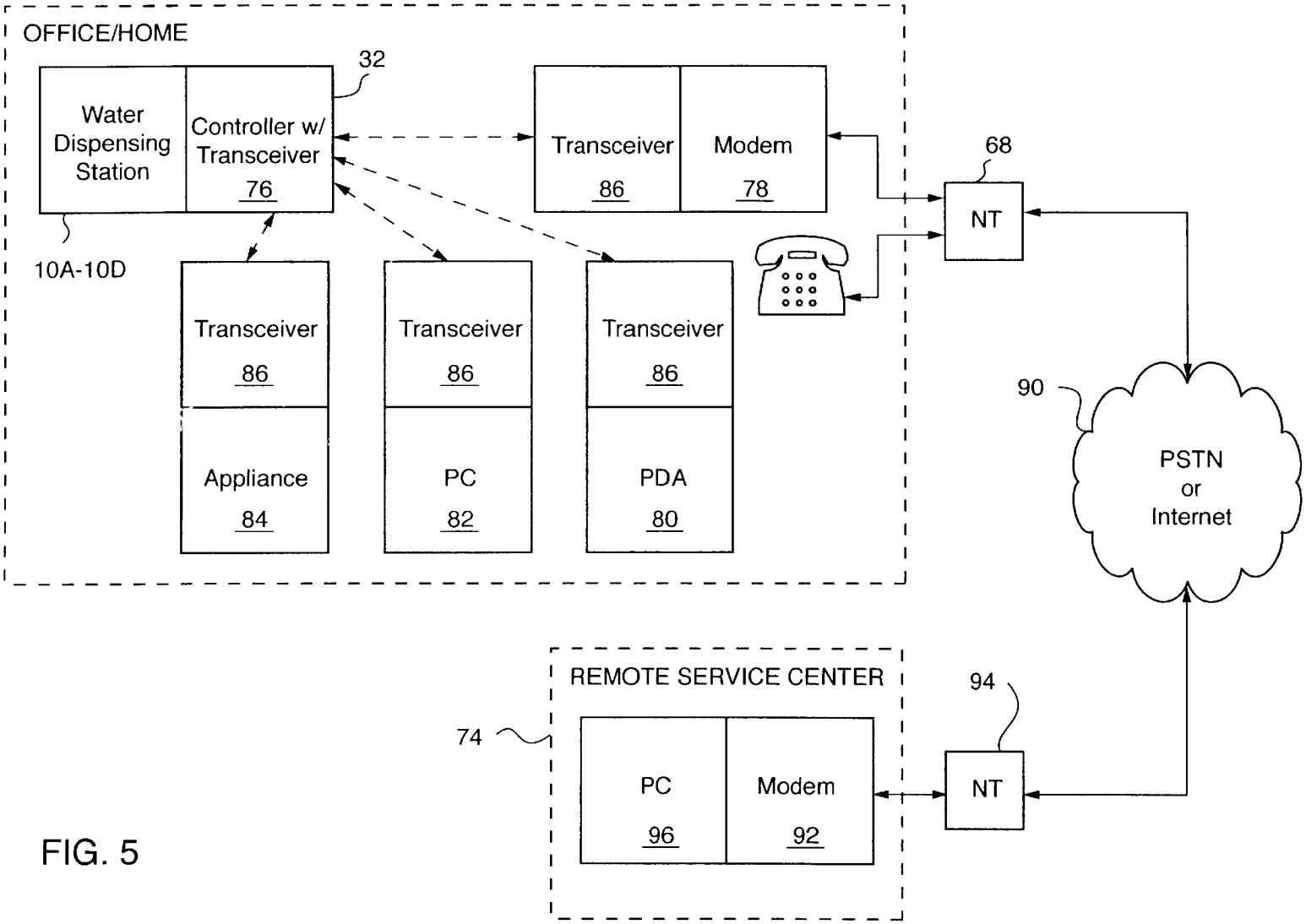
FIG. 5 is a diagrammatic view of a water dispensing system according to a first embodiment of the present invention.

As best shown in FIG. 5, the transceiver 76 of the water dispensing station 10A–10D can be in communication with a wide variety of auxiliary devices such as, for example, a modem 78, a personal digital assistant (PDA) 80, a personal computer (PC) 82, or another appliance 84 such as, for example, a refrigerator or a house/kitchen control center. Each of the external devices have a transceiver 86 adapted to communicate with the transceiver 76 of the water dispensing station 10A–10D. The illustrated modem 78 is connected to a network termination (NT) 88 of the public switched telephone network (PSTN) 90 so that it can communicate with a second modem 92 which is connected to another NT 94 of the PSTN 90 at the remote service center 74 or other location. It is noted that the modems 78, 92 can alternatively communicate over other communication networks such as, for example, the Internet, wireless telecommunication networks, and/or cable networks. It is also noted that the modem 78 can alternatively be "hard wired" to the controller 32, that is connected by a suitable cable or wire and/or the modem 78 can alternatively be integral with the water dispensing station cabinet 12, that is located within or connected to the cabinet 12.

During normal operation of the water dispensing station 10A–10D, if the controller 32 determines, and/or receives information from the temperature sensors 50, 52, 53, the refrigeration system compressor 62, heating system heating element 64, and/or user input devices 70 that a condition exists which requires a delivery, service, repair, replacement or the like, the controller automatically initiates communication with the remote service center 74. The controller 32 wirelessly communicates to the modem 78 via the transceivers 76, 86. Because the connection between the dispensing station 10A–10D and the modem 78 is wireless, the water dispensing station 10A–10D does not need to be located near a phone jack or other communication network access connection. Therefore, the water dispensing station 10A–10D can be located at any desired position such as on the floor or hidden behind a piece of furniture etc. The modem 78 typically needs a battery, line voltage power, or other suitable power source. The modem 78 in turn is connected to the PSTN 90, or other suitable communication network. The information is sent via the modem 78 over the PSTN 90 to a computer, fax, or other auxiliary device at the remote service center 74. The information can be left as a message at the remote service center 74 with a description of the problem/issue for a follow-up delivery and/or service call. Additionally, a computer (PC) 96 at the remote service center 74 can automatically run diagnostics and make any necessary adjustments over the phone line.

For example, if the controller determines that the user is down to his last bottle of water 14, the controller 32 automatically calls the service center 74 and informs the service center 74 of the need for bottle delivery. The service center 74 then either calls the user to schedule a delivery or sends electronic messages to the user via the controller 32 and display screen 68 or a separate stand alone computer to schedule a delivery. If the controller 32 determines that a filter needs to be replaced, the process can operate as described hereinabove for bottled water to schedule a service call or alternatively the replacement filter can be shipped directly to the user via the mail so that no service call is necessary. The replacement filter can be automatically billed to an on file credit or debit card of the user and the user can be automatically notified of the transaction by electronic message to the display screen 68 and/or an e-mail to a separate computer. A suitable electronic message or e-mail can be, for example:

**********
From: Your Drinking Water Provider Sent: June 27, 2000 12:00AM
To: Customer X
cc:
Subject: Service Alert
Your Intelli-Water drinking water system has informed us that it is time for new filters. We will be shipping the new filters today via UPS.
You should receive them by Friday.
Replacing the old filters is very easy. Just follow the video instructions on the LCD screen located on the front of your Intelli-Water system.
You may also view our on-line video at www.Intellifilter.com.
We will Automatically bill your American Express account.
If you need to reach us, just press the red button on the top of your Intelli-water system. We will telephone you shortly there after. Or, you may call 1-800-I-N-T-E-L-L-I
Thank you for selecting us as your drinking water supplier!
**********

The customer replaces the filter on his own when it is received in the mail. Instructions for replacing the filter can be provided by printed and/or video instructions with the replacement, by on-line written and/or video instructions at an Internet web site, and/or written and/or video instruction on the display screen 68. It is noted that such procedures can be utilized with other items such as water bottles 14 which are delivered at the customer's door step.

Sometimes the water dispensing station 10A–10D can be working properly, but the user is dissatisfied for some reason. For example, the user may be dissatisfied with the cold or hot water temperature. Typically, the user calls the remote service center 74 to tell them that "the station is not working". Often the station 10A–10D is working properly but the season has changed and the water temperature just doesn't "feel right" for the current season. Preferably, the user can automatically initiate a call to the service center 74 by pressing the service or call button 72 or by selecting appropriate prompts on the display screen 68. The controller 32 will automatically connect the station 10A–10D to the service center 74 as described above and either prompt the service center 74 to call the user or initiate a service call. Often a service call can be avoided because the remote service center 74 can call and connect to the water dispensing station 10A–10D and make suitable adjustments from the remote location 74. For example, the service center 74 can call and make adjustments to the cold and/or hot water temperatures. Therefore, the service technician makes the changes from his office instead of the service technician driving to the location of the water dispensing station. The ability of the remote service center 74 to remotely communicate with the water dispensing station 10A–10D is also advantageous in other scenarios such as, for example, a follow-up check on a station 10A–10D that has been repaired, as part of an energy tracking program, or any other service/performance related issue.

Figure 6:
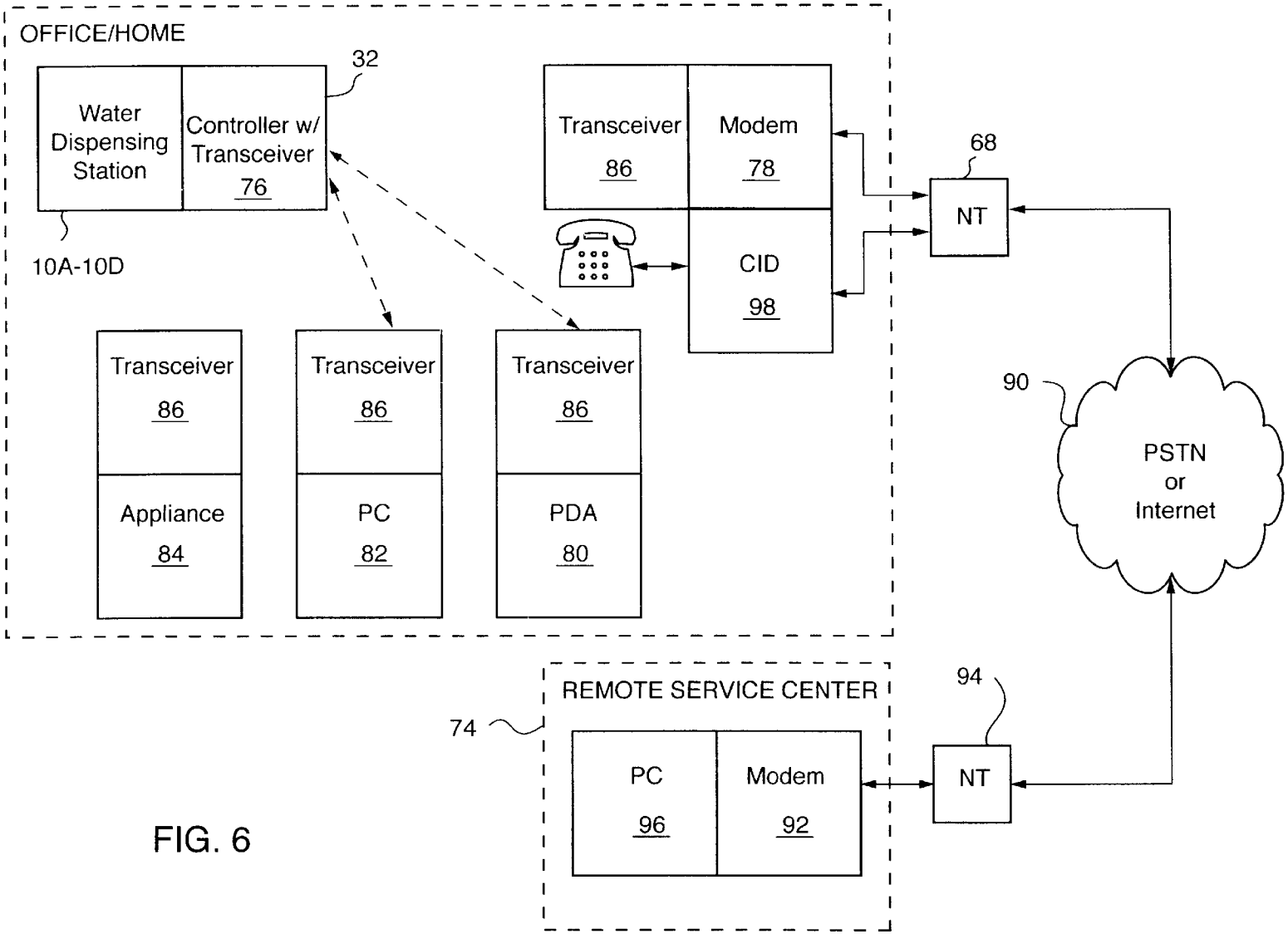
FIG. 6 is a diagrammatic view of a water dispensing system according to a second embodiment of the present invention.
Figure 7:
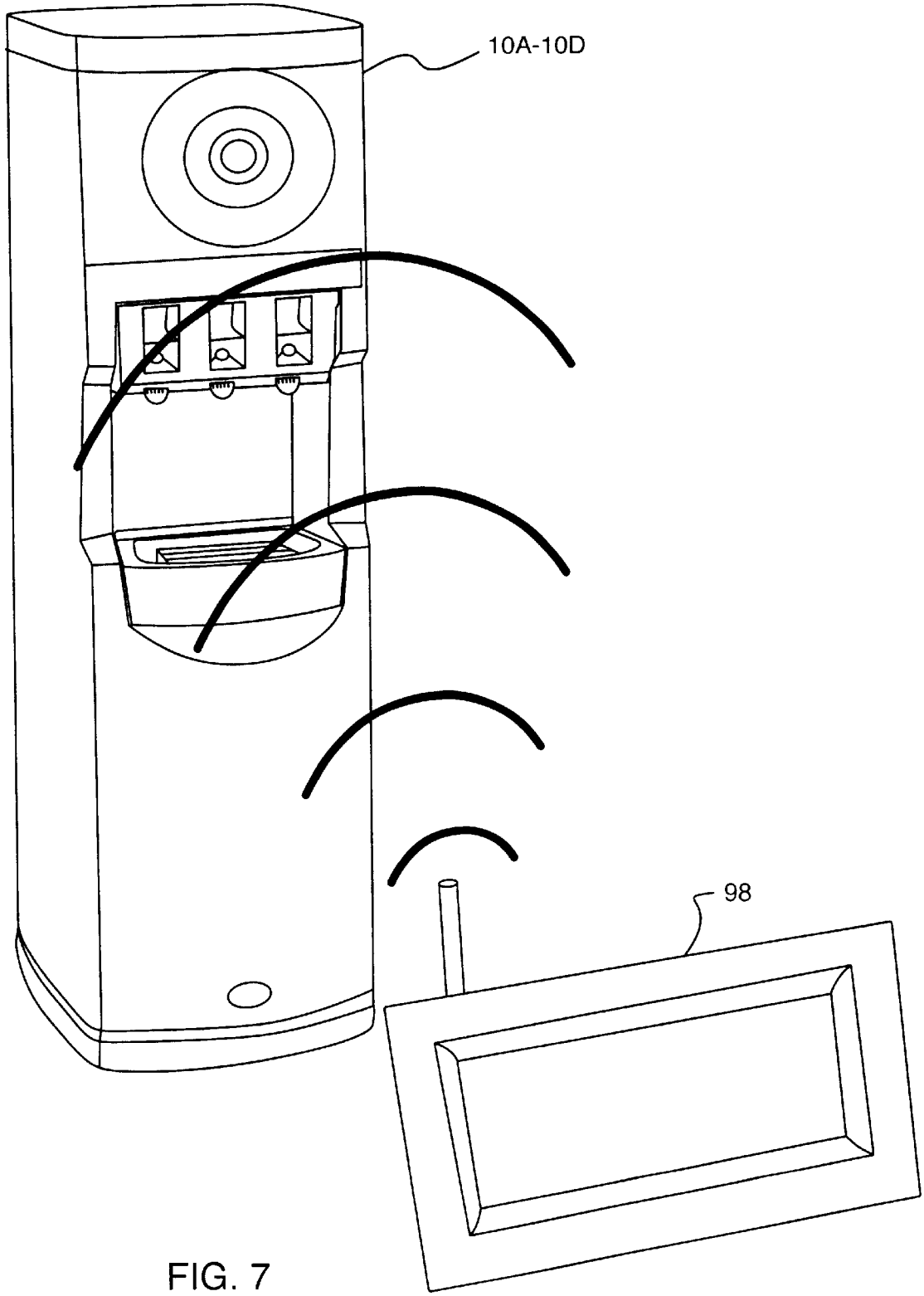
FIG. 7 is a perspective view of a water dispensing station of FIG. 6 showing a caller identification device (CID) wirelessly connected to a free-standing dispensing cabinet.

As best shown in FIGS. 6 and 7, the modem can be connected to a caller identification device (CID) 98 so that calls from the remote service center 74 can be automatically directed to the water dispensing station 10A–10D. Such a configuration eliminates the need for a dedicated phone line for the modem 78. The remote service center 74 dials the switch identification number of the user's phone line and the call is received by the CID 98. If the CID 98 identifies the call as coming from a remote service center 74, the call is automatically directed to the modem 78 which is wirelessly in communication with the controller 32. If the CID 98 does not identify the call as coming from the remote service center 74, the call is automatically directed to the user's phone or other device just as a normal call would be connected. Once the service technician is in communication with the controller 32, the service technician can run a diagnostic on the station 10A–10D. Any needed adjustments can be made such as, for example, adjust control settings, adjust on/off times for energy saver mode, check the number of remaining bottles 14, check the remaining filter life, or check any other item the controller 32 is monitoring.

Figure 8:
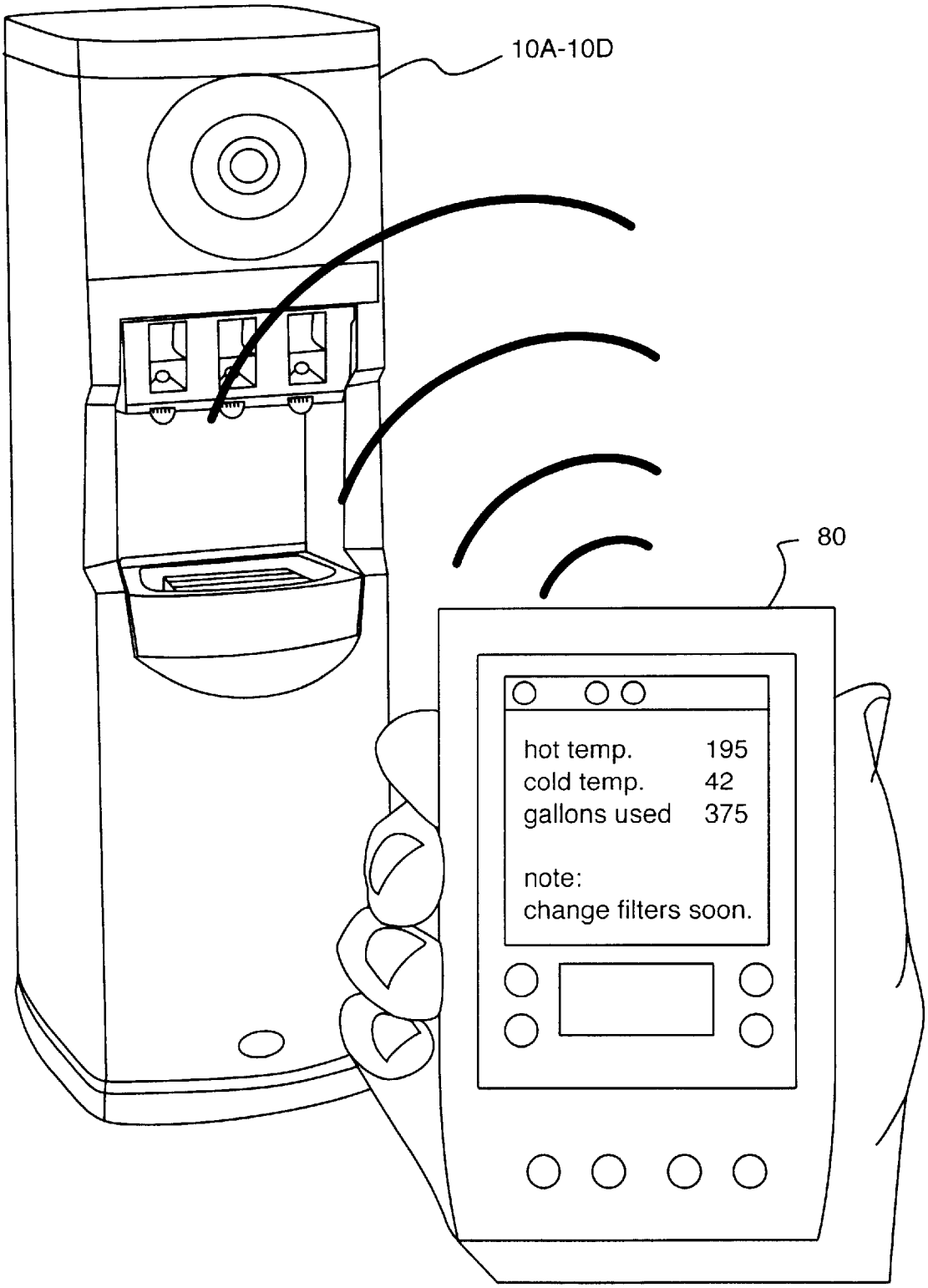
FIG. 8 is a perspective view of a water dispensing station of FIGS. 5 and 6 showing a personal digital assistant (PDA) wirelessly connected to the free-standing dispensing cabinet.

As best shown in FIGS. 5, 6, and 8, the water dispensing station 10A–10D can also communicate with a service technician on a local service call through the personal digital assistant (PDA) 80, that is a handheld computer, or other portable computer such as, for example, those available from Palm, Handspring, and/or Hewlett Packard and the like. When a service technician makes a service call, such as a bottled water delivery or a filter replacement, the water dispensing station 10A–10D and the PDA 80 automatically recognize each other and link-up. The PDA 80 preferably records information including the date of the service call, the time of the service call, and the serial number of the water dispensing 10A–10D being serviced. The PDA 80 then preferably prompts the service technician to enter additional information such as, for example:

| | |
|---|---|
| What type of service call? | water delivery<br>maintenance<br>filter replacement |

-continued

| | |
|---|---|
| How many bottles delivered? | _____ |
| How many bottles returned? | _____ |
| Cooler sanitized? | Yes No |
| Cooler appearance? | Good Fair Bad |

This information is collected for each water distribution station 10A–10D as the service technician completes his route during each day. At the end of the day, when the service technician returns to the office, the PDA 80 and office computer 96 preferably automatically link-up and the information is downloaded from the PDA 80 to the office computer 96. The office computer 96 can automatically generate and print bills for the service calls by identifying respective customers using the serial numbers and determining billing amounts by the type and amount of service provided. Such a system enables a service technician to make a greater number of deliveries during the day because he does not have to make a written record at each location. Additionally, the system reduces billing errors because it removes much of the manual data entry and reduces the need for clerical help in the office.

As best shown in FIGS. 5 and 6, the transceiver 76 can also be in communication with a transceiver of the local personal computer (PC) 82. The personal computer 82 can be utilized to for example, control video displayed on the display screen 68. The display screen 68 can be utilized to display advertisements, messages, current stock reports, music videos, television broadcast such as CNN or the like, or other newsworthy events. The displayed information can be programmed and controlled by a home owner or an office manager through the PC 82.

The transceiver 76 can also be in communication with a transceiver 86 of another appliance 84 such as, for example, a refrigerator or a kitchen manager. The refrigerator is preferably a "smart refrigerator" which can automatically order items, such as bottled water 14, via the Internet from a grocery store when supplies are low. Examples of smart refrigerators are the ScreenFridge available from AB Electrolux of Stockholm, Sweden or Frigidaire Home Products, Augusta Ga. A kitchen manager is an appliance which allows a person to communicate with and control all of the appliances in a home from the kitchen. An example of a kitchen manager is the THALIA HomeHelper Kitchen Console which is available from the Sunbeam Corporation, Boca Raton, Fla., to communicate with and control all "HLT-Smart" appliances within a home.

It should be appreciated that each of the features described hereinabove with regard to the various embodiments can be used alone with the embodiment it is specifically disclosed with or any of the other disclosed embodiments and/or can be used in combination with any other feature or features of the embodiment it is specifically disclosed with or any feature or feature of other disclosed embodiments.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the modem can communicate to the central office over many different communication networks such as the Internet and/or various wireless networks. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the claims when interpreted in accordance with the benefit to which they are fairly, legally, and equitably entitled.

What is claimed is:

1. A water dispensing station comprising, in combination:

a source of water;

a water temperature adjustment system connected to the source of water and adapted to adjust water temperature obtained from the source of water;

a temperature sensor positioned to sense water temperature of water in the temperature adjusting system;

a dispensing system connected to the water temperature adjusting system and adapted to selectively dispense water;

a controller having processing means and memory means and in communication with the water temperature adjusting system and the temperature sensor;

wherein said controller is adapted to receive and store water temperature information from the temperature sensor; and communication means coupled to said controller for communicating information to and from said controller relative to a remote service center.

2. The water dispensing station according to claim 1, wherein said water temperature adjusting system is a refrigeration system including a compressor.

3. The water dispensing station according to claim 2, wherein the refrigeration system includes a current sensor adapted to sense operation of the compressor and in communication with the controller, and wherein said controller is adapted to receive and store operation information from the temperature sensor.

4. The water dispensing station according to claim 3, wherein the controller includes clock means and is adapted to monitor and store an amount of time the compressor is operating.

5. The water dispensing station according to claim 1, wherein said water temperature adjusting system is a heating system including a heating element.

6. The water dispensing station according to claim 5, wherein the heating system includes a current sensor adapted to sense operation of the heating system and in communication with the controller, and wherein said controller is adapted to receive and store operation information from the temperature sensor.

7. The water dispensing station according to claim 3, wherein the controller includes clock means and is adapted to monitor and store time the heating element is operating.

8. The water dispensing station according to claim 1, further comprising: a water filtering system connecting the source of water and the water temperature adjusting system and including at least one filter; and wherein the controller is adapted to store the time of last change of the filter and to determine an amount of time passed since the stored time of last change of filter.

9. The water dispensing station according to claim 1, further comprising: a water flow meter adapted to sense the amount of water dispensed from the dispensing system;

a water filtering system connecting the source of water and the water temperature adjusting system and including at least one filter; and wherein the controller is adapted to store the time of last change of the filter and to determine the total amount of water dispensed since the stored time of last change of filter.

10. The water dispensing station according to claim 1, further comprising: a reverse osmosis system connecting the source of water and the water temperature adjusting system and in communication with the controller; and wherein the controller is adapted to monitor a total dissolved solids of the reverse osmosis system.

11. The water dispensing station according to claim 1, wherein said source of water includes a water bottle; and wherein the controller is adapted to store a time of last delivery of water bottles and a total number of water bottles delivered.

12. The water dispensing station according to claim 11, further comprising: a water flow meter adapted to sense the amount of water dispensed from the dispensing system; and wherein the controller is adapted to determine the total number of water bottles dispensed since the stored time of last delivery.

13. The water dispensing station according to claim 1, wherein the controller is adapted to determine periods when the dispensing system has no usage and to automatically shut off the water temperature adjusting system during the periods.

14. The water dispensing station according to claim 1, further comprising an alarm in communication with the controller, and wherein the controller is adapted to activate the alarm when the controller determines there is a component failure.

15. The water dispensing station according to claim 1, further comprising an alarm in communication with the controller, and wherein the controller is adapted to activate the alarm when the controller determines there is a water leak.

16. The water dispensing station according to claim 1, further comprising a display screen in communication with the controller and adapted to provide information to a user; and user input devices in communication with the controller and provide information to the controller.

17. The water dispensing station according to claim 1, wherein said controller is adapted to store a unique serial number for the water dispensing station.

18. The water dispensing station according to claim 1, wherein said controller is adapted to store service records for the water dispensing station.

19. The water dispensing station according to claim 1, wherein said communication means comprises a modem in communication with the controller.

20. The water dispensing station according to claim 1, wherein said communication means comprises a transceiver in communication with the controller, and wherein the controller is adapted to communicate with at least one of a personal digital assistant, a personal computer, and a modem via the transceiver.

21. A water dispensing station comprising, in combination:

a source of water;

a water treatment system connected to the source of water and adapted to treat water obtained from the source of water;

a dispensing system connected to the water treatment system and adapted to selectively dispense water;

a controller having processing means and memory means and in communication with the water treatment system;

a modem in communication with the controller; and wherein the controller is adapted to communicate information via the modem to a remote service center.

22. The water dispensing station according to claim 21, wherein the controller is adapted to automatically initiate calls to the remote service center.

23. The water dispensing station according to claim 22, further comprising a call button connected to the controller, and wherein the controller is adapted to automatically initiate a call to the remote service center when the call button is activated by a user.

24. The water dispensing station according to claim 21, wherein the controller is adapted to automatically receive calls to the remote service center.

25. The water dispensing station according to claim 24, wherein the controller is adapted to automatically shut down the water dispensing station from the remote service center such that the water dispensing station is inoperable.

26. The water dispensing station according to claim 21, wherein the controller is adapted to run diagnostics and provide diagnostic results to the remote service center via the modem.

27. The water dispensing station according to claim 21, further comprising a display screen in communication with the controller and adapted to provide information to a user and user input devices in communication with the controller and provide information to the controller, and wherein the controller is adapted to display information received from the remote service center on the display screen.

28. The water dispensing station according to claim 21, wherein the water treatment system includes a filtering system having at least one filter;

wherein the controller is adapted to store the time of last change of the filter and to determine when the filter needs replaced; and wherein the controller is adapted to automatically alert the remote service center via the modem that the filter needs replaced.

29. The water dispensing station according to claim 21, wherein the water treatment system includes a reverse osmosis system;

wherein the controller is adapted to monitor a total dissolved solids of the reverse osmosis system and determine when the reverse osmosis system needs service; and wherein the controller is adapted to automatically alert the remote service center via the modem that the reverse osmosis system needs service.

30. The water dispensing station according to claim 21, wherein said source of water includes a water bottle;

wherein the controller is adapted to store a time of last delivery of water bottles and a total number of water bottles delivered and determine when additional water bottles should be delivered; and wherein the controller is adapted to automatically alert the remote service center via the modem that the additional water bottles should be delivered.

31. The water dispensing station according to claim 21, wherein the controller is in communication with the modem via transceivers.

32. A water dispensing station comprising, in combination:

a source of water;

a water treatment system connected to the source of water and adapted to treat water obtained from the source of water;

a dispensing system connected to the water treatment system and adapted to selectively dispense water;

a controller having processing means and memory means and in communication with the water treatment system;

a transceiver in communication with the controller, and wherein the controller is adapted to communicate with at least one of a personal digital assistant, a personal computer, and a modem via the transceiver.

33. The water dispensing station according to claim 32, wherein said controller is adapted to store a unique serial number for the water dispensing station.

34. The water dispensing station according to claim 32, wherein said controller is adapted to store service records for the water dispensing station.

* * * * *